United States Patent [19]

London, Jr.

[11] 4,016,715

[45] Apr. 12, 1977

[54] HIGH STRETCH YARN TEXTURING, DYEING AND PACKAGE PRODUCTION

[75] Inventor: Joe F. London, Jr., Greensboro, N.C.

[73] Assignee: Burlington Industries, Inc., Greensboro, N.C.

[22] Filed: Oct. 14, 1975

[21] Appl. No.: 622,118

[52] U.S. Cl. ..... 57/157 TS; 57/157 R; 57/157 F

[51] Int. Cl.[2] ..... D02G 1/20

[58] Field of Search ..... 57/157 R, 157 F, 157 TS; 242/45

[56] References Cited

UNITED STATES PATENTS

| | | | |
|---|---|---|---|
| 3,281,087 | 10/1966 | Claiborne et al. | 242/45 X |
| 3,316,705 | 5/1967 | Nava | 57/157 TS |
| 3,535,866 | 10/1970 | Tsuruta et al. | 57/157 F X |
| 3,611,701 | 10/1971 | Scherzberg | 57/157 TS |
| 3,824,776 | 7/1974 | London, Jr. | 57/157 F X |
| 3,831,362 | 8/1974 | Dudzik | 57/157 TS X |

*Primary Examiner*—Richard C. Queisser
*Assistant Examiner*—Charles Gorenstein
*Attorney, Agent, or Firm*—Cushman, Darby & Cushman

[57] ABSTRACT

A method and apparatus for one step texturing and package preparation of high stretch continuous filament yarn for ultimate package dyeing. Continuous filament yarn is fed from a supply across a false twisting assembly, and a false twist is imparted thereto. The yarn is then passed over a roller and directed generally downwardly toward a takeup assembly including a dye spring. The yarn is overfed to the dye spring so that the yarn may relax completely and will have maximum skein shrinkage after dyeing. This is accomplished by passing the yarn through an air jet, resulting in an overfeed of up to 70–100 percent, which overfeed is not possible with conventional methods. The yarn package formed is soft, and may be package dyed according to conventional procedures.

5 Claims, 3 Drawing Figures

HIGH STRETCH YARN TEXTURING, DYEING AND PACKAGE PRODUCTION

BACKGROUND AND SUMMARY OF THE INVENTION

The invention relates to a method and apparatus for providing the largest amount of skein shrinkage possible after dyeing for a high stretch continuous filament yarn, and for accomplishing yarn texturing and package production for dyeing in one process. In the production of high stretch or high bulk yarns, the normal process of false twist texturing is accomplished by either underfeeding or overfeeding the yarn with a feed roller across a heater. The yarn while passing across the heater is twisted to a very high degree by a false twist spindle just above the heater. As the yarn passes by the spindle, the yarn is in an untwisted state, but due to the heat setting which occurred while the yarn was twisted the untwisted yarn possesses a memory to retain the twisted configuration. This memory or set produces the desired bulk and stretch. The yarn is then pulled from the spindle by a second set of feed rollers to a take-up package. Problems have been encountered in the past with package dyeing when production of yarn with a high level of stretch or bulk after package dyeing was desired. One of such problems is that a high overfeed is required to ensure that the textured yarn is not re-set in a semi-extended state during package dyeing (as a result of the high temperatures and times used in package dyeing), a higher overfeed than is possible with conventional apparatus, to allow the yarn to contract to its relaxed state. Another problem is encountered when ply twisting is used (plied with one end S torque and one end Z torque) — such yarns cannot be overfed to any great extent to a package without first exposing the yarn to heat or moisture to speed up the relaxation of the yarn.

Prior art attempts have been made to provide yarns with acceptable skein shrinkage after package dyeing, including the muff method, spring muff method, and Ratti uptwister method. The muff method consists of the steps of texturing, plying, muff (skeins) winding, tub dyeing, extracting, drying and conditioning, expanding, and coning. The spring muff method consists of the steps of texturing, ply twisting, spring muffing, package dyeing, and coning. Spring muffing consists of over-feeding textured yarn across a heater plate which allows the yarn to contract to its maximum potential and winding the contracted yarn onto a dye spring. The Ratti uptwister method combines ply twisting, relaxing in the presence of heat, and overfeeding to a dye spring. While all three of these methods are generally useful, problems are associated therewith — for instance in muff dyeing the yarn tends to tangle in the dye bath and the number of steps involved makes it very expensive. In the spring muff approach ply twisting and spring muffing are necessary. In the Ratti uptwister approach a redraw winding process is required to prepare the yarn for uptwisting. None of these processes is as simple as the present invention.

According to the method of the present invention, yarn is textured and prepared into a package in one process; yarn (single or ply filament yarns) is passed from first feed rollers over a heater and false twisted by a false twisting spindle(s) while over the heater. The yarn then is taken up by a second set of feed rollers, directed generally downwardly, and passed to an air jet such as that shown in U.S. Pat. No. 3,824,776, the disclosure of which is hereby incorporated by reference in the present disclosure. (Also see U.S. application Ser. Nos. 217,060 filed Jan. 11, 1972; 421,850 filed Dec. 5, 1973; 489,724 filed July 18, 1974, and 614,660 filed Sept. 18, 1975.) From the air jet the yarn is directed downwardly to a dye spring, the air jet maintaining tension on the second set of feed rollers and providing sufficient overfeed (up to 70–100percent) to the dye spring take-up assembly to force the yarn to contract to its maximum skein shrinkage while being wound onto the dye spring, and also interlacing the yarn filaments if more than one yarn is used. Thus according to the present invention the yarn reaches its full shrinkage potential on the take-up package, and after dyeing has equal to or greater skein shrinkage than if processed according to conventional methods.

It is the primary object of the present invention to provide an improved method and apparatus for the texturing and dye package preparation of high stretch continuous filament yarns. This and other objects of the invention will become clear from an inspection of the detailed description of the invention, and from the appended claims.

DETAILED DESCRIPTION OF THE INVENTION

Figure 1:
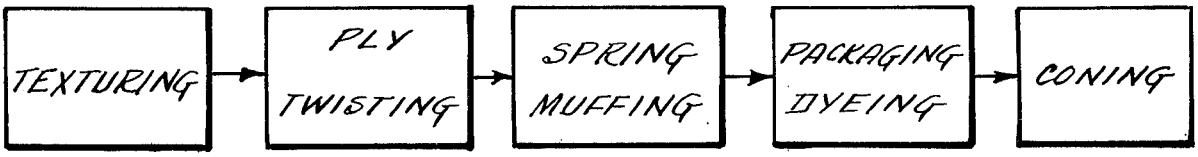
Fig. 1 (PRIOR ART)
FIG. 1 is a schematic showing of a conventional method for preparing a yarn package of high stretch yarn.

An exemplary prior art arrangement for the package dyeing of yarn is shown schematically in FIG. 1 and includes the steps of texturing, ply twisting, spring muffing, package dyeing, and coning. When such a method is utilized with stretch yarns, it is desired to maintain the maximum skein shrinkage of the yarn after dyeing that is possible. Other prior art methods include the muff method and the Ratti uptwister method. The method according to the present invention replaces the texturing, ply twisting, and spring muffing steps of the prior arrangement according to FIG. 1, and results in a yarn having a higher skein shrinkage.

Figure 2:
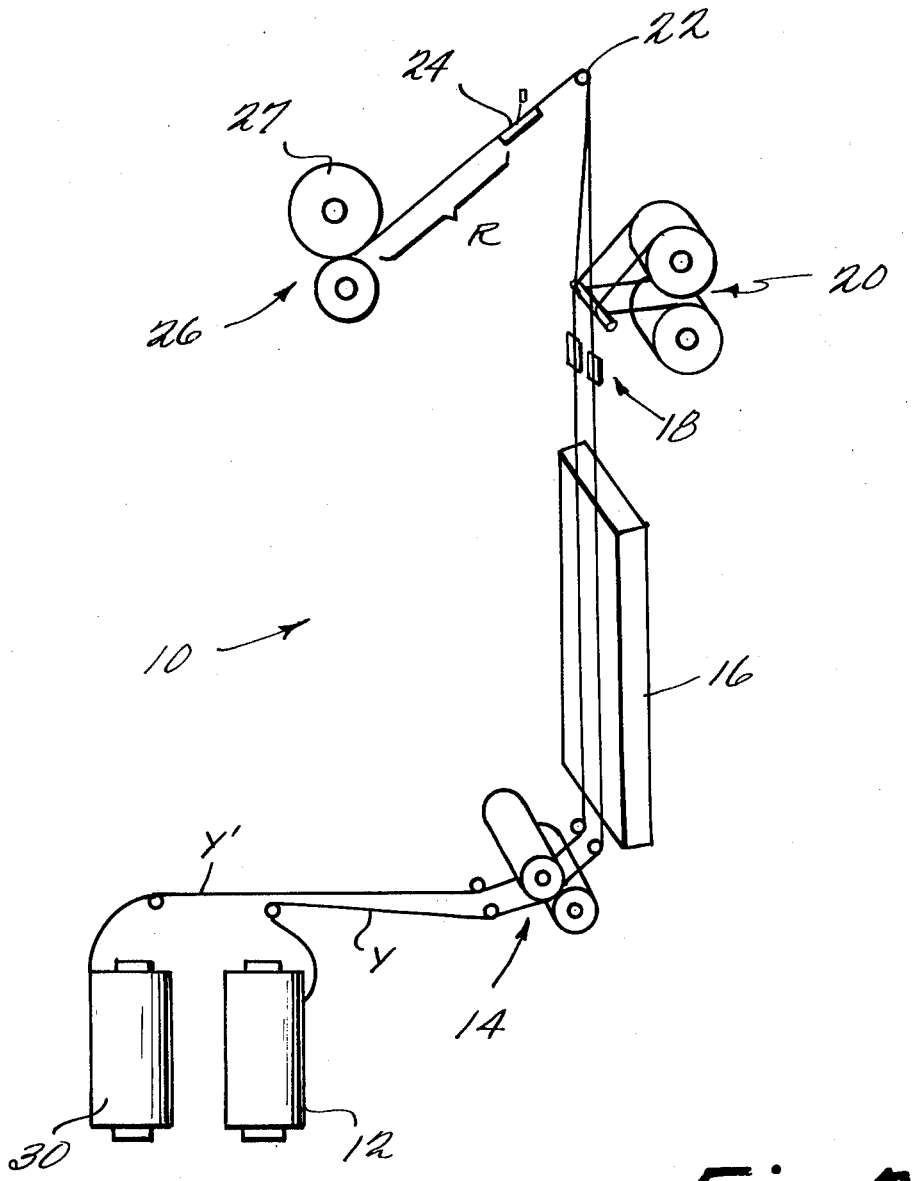
FIG. 2 is a diagrammatic showing of exemplary apparatus for yarn texturing and package production according to the present invention.

Apparatus according to the present invention and for practicing the method of the present invention is shown generally at 10 in FIG. 2. The apparatus generally comprises a supply package 12 of yarn Y, a pair of first feed rollers 14 for pulling the yarn Y from the package 12 and either underfeeding it or overfeeding it to the conventional heater 16 (i.e. an electrically heated contact surface) of a texturing machine. Yarn Y passes from heater 16 to a false twist spindle 18 which imparts a "Z" or an "S" torque to the yarn Y, and the "twist" applied passes downwardly to heater 16 wherein the twist is heat set as in a conventional texturing operation. The yarn is pulled from spindle 18 by a second pair of feed rollers 20. If desired, the second pair of feed rollers 20 may feed the yarn Y to a second heater (not shown) for relaxing the yarn, but a second heater is not necessary according to the teachings of the present invention.

Figure 3:
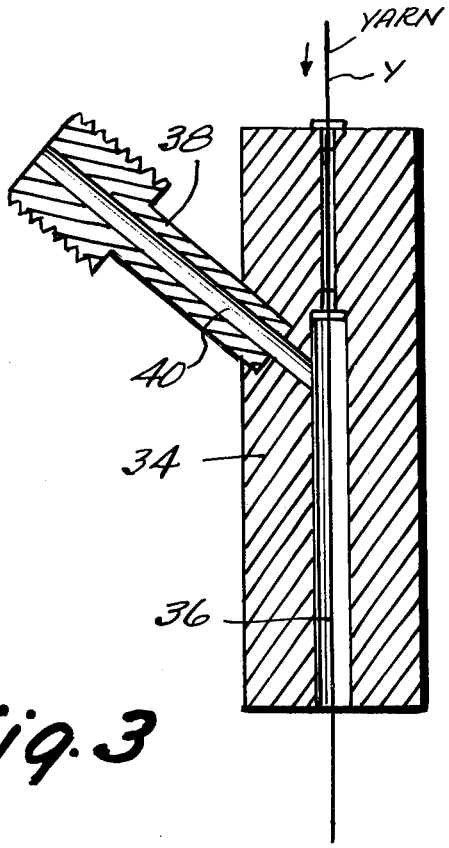
FIG. 3 is a vertical sectional view through an exemplary air jet utilizable in the apparatus of the present invention.

From the second pair of feed rollers 20, the yarn Y passes over a roll 22 or the like for changing the direction thereof, and moves generally downwardly into an air jet 24. The yarn Y passes generally downwardly through the air jet 24 in order to obtain the maximum overfeed possible to produce a softly wound package — overfeeds of 70–100percent may be used according to the present invention, much higher than is practically achievable with conventional roll arrangements, 30 percent is often the maximum achievable with conventional overfeed arrangements, and 5–8 percent of that is lost due to pure yarn shrinkage and another 5–15 percent lost due to yarn-to-yarn interference in the package so that real overfeed which would produce stretch or skein shrinkage conventionally is only 2–10 percent! The air jet 24 may be of the kind shown in FIGS. 2 and 3 of U.S. Pat. No. 3,824,776, the disclosure of which is hereby incorporated by reference herein. As shown in FIG. 3 of this application, the air jet 24 may take the form of a body 34 of steel or other metal having a stepped tubular bore or passage 36 disposed therethrough, the yarn Y running through the passage 36 in the direction of the arrow. Air is introduced through air inlet passage 40 of air inlet 38, the inlet 38 being positioned at an angle of 45°–75° (preferably about 53°) to the yarn Y. The dimensions of the various components of the air jet may be as shown in FIG. 3. The air jet 24 functions to maintain tensions on the feed rollers 20 so that no wrapping occurs thereon, and forces the yarn Y to contract to its maximum skein shrinkage as it overfeeds the yarn to the take-up assembly 26, including dye spring 27. The result is high stretch yarn on dye spring 27 that is in its relaxed state (the high overfeed of the yarn allowing complete relaxation thereof in area R), and after package dyeing of the yarn on dye spring 27 according to conventional techniques, the yarn will have increased skein shrinkage as opposed to yarn dyed according to prior art techniques such as that illustrated in FIG. 1, and the real twisting (i.e. ply twisting) step of the prior art methods is eliminated. A very soft package is wound according to the present invention.

In addition to providing for proper tension and overfeed of the yarn Y from the rollers 20 to the assembly 26, the air jet 24 may also be used for interlacing two or more filament yarns. A second supply package 30 having yarn Y′ may be provided in association with first feed rollers 14 and subjected to the same treatment as yarn Y, and then run through the air jet 24 with yarn Y. The final yarn that is produced and wound on dye spring 27 consists of filament yarns Y and Y′ interlaced. Yarn Y may be given an S torque and yarn Y′ a Z torque to provide for a better interlaced product.

Examples of high stretch yarns produced according to the present invention and the resultant skein shrinkage thereof are provided below were textured on a Leesona 553 texturing machine:

EXAMPLE

| | A | B |
|---|---|---|
| Yarn | 2/100/34 T-288 | 2/70/34 T-288 |
| Spindle speed | 210,000 | 240,000 |
| Temperature | 440° F | 440° F |
| Bottom overfeed | 0% | 0% |
| TPI (turns/inch) | 71 | 79.3 |
| Top overfeed | 77.6% | 77.6% |

EXAMPLE-continued

| | A | B |
|---|---|---|
| Air pressure (jet) | 15 psi | 15 psi |
| Skein shrinkage | 27% | 31% |
| Conv. spring muff yarn pack. skein shrinkage | 24% | 24% |

As may be readily observed, the yarns according to the present invention had significantly more skein shrinkage after dyeing than the same yarns treated according to the conventional spring muff method shown in FIG. 1.

It will thus be seen that according to the present invention a method and apparatus have been provided for the texturing and package preparation of a high stretch continuous filament yarn that results in maximum skein shrinkage after dyeing. While the invention has been herein shown and described in what is presently conceived to be the most practical and preferred embodiment, it will be apparent to those of ordinary skill in the art that many modifications may be made thereof within the scope of the present invention, which scope is to be accorded the broadest interpretation of the appended claims so as to encompass all equivalent structures and devices.

What is claimed is:

1. A method of high stretch yarn texturing and yarn package preparation comprising the steps of a. false twist texturing a continuous filament yarn at a false twisting station, b. directing said false twist textured continuous filament yarn from said false twisting station generally downwardly and toward a take-up assembly including a dye spring, c. overfeeding said yarn to said take-up assembly, the overfeed being greater than 30 percent, so that said yarn may relax before being taken up by said die spring and so that the skein shrinkage of said yarn after dyeing will be maximized, and interlacing said yarn filaments while directing them downwardly and overfeeding them to said take-up assembly, to produce a yarn package, and d. package dyeing the yarn package so produced.

2. A method as recited in claim 1 wherein two continuous filament yarns are provided and wherein one of said yarns is given an S torque during said false twist texturing and the other of said yarns is given a Z torque.

3. A method as recited in claim 1 wherein said yarn is composed of synthetic thermoplastic multifilaments.

4. A method as recited in claim 1 wherein the overfeeding of said yarn to said take-up assembly is accomplished by passing said yarn through an air jet.

5. A uniformly shrunk, dyed, relaxed false twist textured and air jet interlaced multi-filament stretch yarn produced by false twist texturing a continuous filament yarn at a false twisting station, directing said false twist textured continuous filament yarn from said false twist station generally downwardly and toward a take-up assembly including a dye spring, overfeeding said yarn to said take-up assembly at an overfeed greater than 30 percent, so that said yarn may relax before being taken up by said dye spring in order that the skein shrinkage of said yarn after dyeing will be maximized, and interlacing said yarn filaments while overfeeding them to take-up assembly and package dyeing the yarn package so produced.

* * * * *

UNITED STATES PATENT OFFICE

CERTIFICATE OF CORRECTION

Patent No. 4,016,715 Dated April 12, 1977

Inventor(s) Joe F. London, Jr.

It is certified that error appears in the above-identified patent and that said Letters Patent are hereby corrected as shown below:

Column 3, lines 27 through 29, delete the sentence "The dimensions of the various components of the air jet may be as shown in FIG. 3."

Column 4, line 38, change "die" to --dye--.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*